US005449424A

United States Patent [19]

Oliver et al.

[11] Patent Number: 5,449,424

[45] Date of Patent: Sep. 12, 1995

[54] METHOD OF PRODUCING PYROTECHNIC MASSES

[75] Inventors: Raymond Oliver, Cleveland, England; Ian J. Kirby, Ayrshire, Scotland; Sek K. Chan, St. Bruno, Canada

[73] Assignees: Imperial Chemical Industries PLC, England; ICI Canada Inc., Canada

[21] Appl. No.: 124,936

[22] Filed: Sep. 21, 1993

[30] Foreign Application Priority Data

Sep. 22, 1992 [GB] United Kingdom ..... 9220052

[51] Int. Cl.[6] ..... D03D 23/00; D03D 43/00; C06B 45/00

[52] U.S. Cl. ..... 149/109.6; 149/2

[58] Field of Search ..... 149/109.6, 2

[56] References Cited

U.S. PATENT DOCUMENTS

| | | | |
|---|---|---|---|
| 4,758,287 | 7/1988 | Pietz | 149/2 |
| 4,994,212 | 2/1991 | Vos et al. | 264/3.3 |
| 5,034,070 | 7/1991 | Goetz et al. | 149/3 |
| 5,051,143 | 9/1991 | Goetz | 149/3 |

*Primary Examiner*—Donald P. Walsh
*Assistant Examiner*—Anthony R. Chi
*Attorney, Agent, or Firm*—Charles Q. Buckwalter, Jr.

[57] ABSTRACT

Precipitation of fine azide core particles with in-situ coating with suspended tiny oxide particles, followed by concentration of the dilute suspension of these bodies to form a slurry with residual dissolved azide in the liquor, and finally converting the slurry in to solid aggregates of the pyrotechnic bodies by e.g. prilling whereby liquid phase evaporation releases dissolved azide causing the pyrotechnic bodies to be adhered together in to larger aggregates.

14 Claims, No Drawings

METHOD OF PRODUCING PYROTECHNIC MASSES

The present invention is directed to the manufacture of pyrotechnic bodies of particular structure to provide more efficient combustion.

This art knows about the combinations of certain pyrotechnic materials to provide combustion for a variety of purposes. U.S. Pat. No. 3,931,040 discloses compositions of sodium azides and metal oxides to form a composition found advantageous for combustion purposes. Therein, the invention was directed toward the production of nitrogen for use in lasers. U.S. Pat. No. 4,021,275 discloses a similar combination of azide, oxide, and nitrate combinations to produce gas generated for safety air bags. U.S. Pat. No. 4,376,002 discloses a combination of azide, metal oxides, and residue control agent for the production of nitrogen gas.

A continuing problem in this art is the production of some composition of pyrotechnic wherein the pyrotechnic reaction ingredients advance towards complete combustion. Heretofore, mixing methods have produced bodies with erratic and uncontrolled metal azide/metal oxide surface coverage. The product generally contained disproportionate metal oxide dispersions on the surface of the metal azide. Copending U.S. application Ser. No. 07/894,807 filed Jun. 6 1992 by one of the inventors named herein (S. K. Chan) advances this art by directing those skilled in this art toward a means of integral juxtaposed reactant placement within a combined body. By appropriate placement of the reactants about a fixed body, the pyrotechnic of the present invention provides a pyrotechnic body of controlled combustion. A pyrotechnic structure comprised of the pyrotechnic bodies may then be combusted by a means known by those skilled in this art with the desired burn rate.

The pyrotechnic is found useful in the fast production of gas for use in an air bag safety restraint system in automobiles, trucks, buses, and/or any other vehicles wherein safety air bags may be found useful. Additionally, military uses, such as gas generating systems for ballasts would be a useful application. Any system, such as gases generated for lasers, which would require the quick production of a gas would find the pyrotechnic body useful.

More particularly, the pyrotechnic body comprises an azide-oxidizer redox couple components wherein said redox couple produces an exothermic reaction, said azide component comprising average particle sizes of less than about 8 microns in its longest crystal dimension and said oxidizer comprising average particle sizes of less than about 1.0 micron in diameter. The azide component present in the pyrotechnic body comprises 40 to 90 weight per cent of the body, preferably 60 to 70 weight per cent and most preferably 64 to 66 weight per cent. The average particle size is less than about 8 microns in length in its longest crystal dimension, preferably less than 5 microns, and most preferably less than 3 microns. The azide is usually combined with a metal or salt of a metal. The metal must be an oxidant capable of interacting in a redox couple with an oxidizer. Preferably the metal is either an alkali metal and/or an alkaline earth metal. In particular the metal azide combination consists essentially of sodium azide, potassium azide, lithium azide, calcium azide and/or barium azide, most preferably sodium azide.

The oxidizer is comprised of an element or elements of the first, second, and/or third transition series elements of the Periodic Chart. The oxidizer may be a single species of the transition series or may be some combination thereof and/or therebetween. Preferably, the oxidizer and/or slagging agent is a metal oxide from the first transition series and/or second transition series such as but not limited to iron, nickel, vanadium, copper, titanium, manganese, zinc, tantalum and/or niobium oxides, and other oxides such as oxides of silicon and/or aluminium, most preferably the metal is a species from iron oxides and/or silicon oxides. Metal oxides are the preferred genus of the present invention, it is contemplated, however, that other generic groups are operable herewith such as the carbonates, sulfides, sulfites, oxalates, halides, in particular chloride, and nitrides and are within the scope of the present invention. A limit of the oxidizer component in its application to the azide is its solubility characteristic in an aqueous solution. However, the limit of operability of the oxidizer component in said body's combustion performance is the promotion of the reaction of the companion component of the azide as it is coupled to the oxidizer component. Essentially, the scope of the present invention includes any reduction/oxidation interaction otherwise known to those skilled in this art as a redox couple, whereby an exothermic reaction is produced by the oxide/oxidizer redox couple and said reaction is sufficient to sustain the combustion of the azide.

The oxidizer component is generally spherical dimensionally, however, spherical geometry is not required. Of the geometries produced as the oxidizer component, on the average the shortest dimension is no greater than 1.0 micron, preferably no greater than 0.5 microns and most preferably no greater than 0.2 microns. The longest dimension of the oxidizer component is not critical to the present invention. Geometries such as platelets, spheres, needles, fibres, and variable geometries may be advantageously combined with the azide component. Spheres are the preferred geometry.

Particle sizes as measured by a Brinkmann 2010 PSA (particle size analyzer) Sybron Corp. Westbury, N.Y. reveal an average size distribution from about 0.5 up to about 30 microns with a mean size of less than 8 microns. Normally in the preferred embodiments the azide component averages for the particle size show consistent measurements in the 1 to 3 micron range.

The oxidizer component is integrally juxtaposed and/or in communication with the azide component. The juxtaposition and/or communication may take a variety of forms, including a core/shell form and a continuous and/or a discontinuous layer encapsulated the azide. Preferably, the azide is evenly coated with the oxidizer. The azide is usually the core in any core/shell combination. In such combination the oxidizer and azide comprise the body. The body may take the form of platelets, spheres, needles, fibres, the other geometrical shapes.

In its most general form, at least one species of the oxidizer component must be present. This requirement is simply to provide a complete redox couple and to provide a complementary component to communicate with the azide. Communication means that the two components physically interact in some manner so that when combustion initiates there is a continued reaction between the two components. It has been observed that combinations of metal oxides provide excellent body components for the production of operable and preferred bodies. In particular, combinations of iron oxide and silicon oxide are preferred for the oxidizer component. However, both the iron oxide and/or the silicon oxide may be used individually in the absence of the other. The oxidizer component should be present from about 10 to 60 weight per cent., preferably 30 to 40 weight per cent and most preferably 34 to 36 weight per cent. Of the combined iron oxide and silicon oxide components it is preferred that the iron oxide range is 0 to 60 per cent, most preferably 20 to 30 weight per cent. The silicon oxide is preferred in 0 to 50 weight per cent, most preferably 5 to 15 weight per cent. The present preferred combination is about 65 weight per cent sodium azide ($NAN_3$), 25 weight per cent iron oxide ($Fe_2O_3$), and 10 weight per cent silicon dioxide ($SiO_2$).

In its most general form, the method of combining the azide and oxidizer components is by a wet chemistry technique. The wet chemistry is generally known to those skilled in this art as a coprecipitation. The method, while taking advantage of coprecipitation techniques, actually precipitates a saturated solubilized component with a colloidal suspension and subsequently provides a means for the separate components to combine in a body form. Preferably the dispersion is accomplished by mechanical mixing means to insure dispersion of the colloidal system and thorough mixing of the components. Finally, the precipitation is effected by mixing the aqueous solution with, for example, an alcohol. Alcohols that are operable are ethanol, iso propanol, methanol, n-propyl alcohol. Ketones such as but not limited to acetone are operable as well. These are examples of liquids that are miscible with water and which are poor solvents for the azide even when somewhat aqueous as a result of the mixing process.

According to U.S. Ser. No. 07/894,807 a method of making pyrotechnic bodies comprises the steps of a) combining an azide component in a saturated first solution with a suspension of a single or a plurality of oxidizer components in a vessel by mechanically mixing, b) discharging said first solution as a controlled spray, c) precipitating said combined azide component and oxidizer component with a second liquid d) forming a pyrotechnic body. Any means for controlling a spray may be used in the above method such as a spray nozzle, atomizer, or some pressurized system. It is preferred with controlled mixing that the atomizing means achieves particles sizes from about less than 12 microns to preferably about 7 microns. Particle sizes are measured in diameter. It is preferred that a spray nozzle be used. The second liquid phase in the above method is preferably an alcohol, most preferably isopropyl alcohol.

The following examples illustrate the invention of U.S. Ser. No. 07/894,807.

EXAMPLE 1

In Example 1, 800 grams of analytical grade NaN3 per 2000 grams of distilled water were combined to obtain a saturated solution of NAN3. 134 grams of Fe203(R-1599D grade, 0.2 micron particle size, obtained from Harcros Pigments, Toronto, Canada) and 48 grams of Cab-O-Sil fumed silica (0.014 micron particle size, obtained from Cabot, Shaker Heights, Ohio) were mixed with the saturated solution and vibrated in an ultrasonic bath to form a dispersed colloidal suspension. The solution is contained and constantly stirred, then pumped under pressure of 20 psi in a "Jetmixer" as the mixing process is described in U.S. Pat. No. 4,911,770 (also UK Patent Specification 2,215,635A), incorporated herein by reference, through a nozzle (obtained from Spraying Systems Company, Wheaton, Ill.) of 1.6 mm diameter at a rate of 0.5 litres per minutes into a mixing chamber. 4 litres of isopropyl alcohol was pumped into the mixing chamber at 1 litre per minute to form an aqueous/alcohol mixture. The mixture was passed through a 1 micron fibreglass filter. The filtered cake was dried in a steel jacketed vessel producing the pyrotechnic bodies as a powder. The Figure in U.S. Ser. No. 07/894,807 shows a typical scanning electron micrograph of the pyrotechnic body.

The powder was mixed with 4 weight per cent water (in the form of a mixture of Tullanox (obtained from Cabot, Shaker Heights, Ohio) and water. The powder was pressed into a mold to form pellets of 6.4 mmby 25.4 mm dimension and dried. The pellets had a density of 1.93 grams per cubic centimetre. The pellets were coated on all sides except one with an epoxy thermoset. The pellets were placed in a high pressure vessel and pressurized to an initial pressure of 1000 psi with nitrogen. The pellets were ignited at the uncoated end by a squib and the linear burn rate was measured. The burn rate was measured at 47 mmper second.

EXAMPLE 2

Example 2 was prepared as Example 1, except that the iron oxide was needle shaped synthetic red iron oxide (Grade 403, average particle size 0.4 microns, Harcros Pigment, Toronto, Canada). The burn rate was measured at 43 mm/s.

EXAMPLE 3

The solution-suspension was mixed as in Example 1, except that isopropanol was poured directly into the solution-suspension without any applied pressure. The filtered cake was treated the same as in Example 1 to give the powder pyrotechnic body.

The pellet was pressed to a density of 2 g per cc. The linear burn rate was measured at 44 mm/s.

EXAMPLE 4 (Comparative)

40 grams of sodium azide, 16.4 grams of iron oxide (R-1599D), and 5.6 grams of silicon oxide (Cab-O-Sil fumed silica) were mechanically combined and ball-milled. The pellet pressed from the balled milled powder had a density of 2.0 g/cc. The resultant linear burn rate was 39 mm/s.

EXAMPLE 5 (Comparative)

In Example 5, the same amount of sodium azide, iron oxide, and silicon oxide were mixed as in Example 4 with 110 ml of water. The mixture was then dried in a steam jacketed vessel. The pellet pressed from the dried powder had a density of 1.93 g/cc. The resultant linear burn rate was 29 mm/s.

The linear burn rate indicates the efficiency of the combustion process. The higher the linear burn rate in mm/s, the more efficient the combustion process. It is noted from these Examples, that the invention of U.S. Ser. No. 07/894,807 allows achievement of an increased linear burn rate.

The present invention extends the teaching of U.S. Ser. No. 07/894,807, and is directed to an improved method of consolidating the pyrotechnic bodies produced in suspension in the precipitation state in to aggregates of granular or prill form which may then be further processed by any desired means into larger masses of pyrotechnic for use in particular gas generant structures, such as vehicle safety restraint inflatable bags - so-called "air-bags".

The method of the present invention begins with the formation of a dilute dispersion of pyrotechnic bodies as above described. This dispersion is preferably produced by the method used and, as a technique described in, U.S. Pat. No. 4,911,770 wherein, in this case, a first aqueous solution of azide containing the particulate oxidizer(s) is fed under a steep pressure gradient through a nozzle (e.g. a spray nozzle) into a chamber containing a liquid medium (which is a poor solvent for the azide) in a manner such that the emergent stream of solution spontaneously fractures into individual small droplets which then interact with the liquid medium in to which they are introduced so as to precipitate azide particles. The spontaneous fracturing is caused by the intense turbulence in the emerging stream approaching, in the limit, isotropic turbulence with eddies of fractured droplet size. The relative proportion of precipitant liquid, e.g. alcohol as above described, fed to the chamber and the water of the azide solution is desirably in the range 2:1 to, say, 10:1. The chosen value will affect the rapidity of the precipitation and the proportion of azide remaining in solution, a factor relevant in subsequent stages of the present method. In a second stage the dilute suspension (say 2–4% by weight of solids in the aqueous liquor) is concentrated to form a slurry by separation of some portion of its aqueous liquor. The slurry will desirably contain in the range of from about 1% by weight (minimum) to, say, 30% by weight of dispersed solids and the liquor should contain at least about 1% by weight of residual dissolved azide. A dilute slurry will require greater processing effort and evaporative energy in the next stage of the process described hereinafter. A too concentrated slurry will interfere with subsequent processing, as will be evident from the following description. Preferably the slurry is produced by means of a hydrocyclone but a centrifuge, magnetic separator, band filtrator or rotary drum strainer can be used. The residual dissolved azide plays a critical role in the next stage of the method, although the amount of residual dissolved azide will desirably be as low as possible consistent with acceptable performance of its subsequent role.

The separated aqueous liquor will in a commercial process be passed to an azide- (and probably also solvent-) recovery stage from which the azide and the solvent may be recycled to earlier process stages i.e. pyrotechnic body formation and precipitation.

The third stage of the present method is the production of granules or, preferably, prills from the slurry by an evaporative stage. In this stage, the object is to produce consolidated aggregates of pyrotechnic bodies wherein the bodies are bonded together by solid azide released by solvent evaporation from the slurry liquor. The aggregates will preferably be essential "dry"- say containing no more than about ½ to 3% by weight of contained water and minimal organic solvent.

Any suitable method of granule formation may be employed e.g. pan granulation, including spray-growth of seed particles. A preferred method for the present process is the use of a prilling tower (or conduit) wherein a continuous spray of slurry droplets falls in a current of gas, such as air or nitrogen, and the liquid content is evaporatively removed to low residual levels forming solid prills which collect in the well of the tower (or conduit) and are removed.

An especially preferred prilling method deploys a vibrated spray head of the type described in European Patent Specification 0320153 (in that instance in relation particularly to the production of ammonium nitrate prills). The vibrated spray head, when suitably "tuned" to the required duty, is able to generate substantially mono size droplets and hence substantially mono size prills. If desired, a closed recycle loop for the gas stream with inline removal of any "fines" and, of course, removal of moisture/vapour acquired in the prilling tower/conduit may be deployed.

At least in the region immediately below the spray head, in to which droplets of liquid are showered, the gas flow may advantageously be co-current when the droplets are small, e.g. 200 microns diameter, and the gas may advantageously be heated to effect rapid evaporation of liquid component. Where terminal velocity levels make it practicable, a counter current flow regime in the prilling tower may be used, at least below the level at which the droplets/semi solid particles begin their vertical free fall.

The product prills withdrawn from the prilling operation may be further processed by for example, drying, coating, compaction, or packaging as loose material prior to ultimate incorporation into the end-use pyrotechnic unit. For gas-generant purposes we have found a prill size ('diameter') of around 200 microns is convenient.

We claim:

1. A process for making a single or plurality of pyrotechnic aggregates comprising pyrotechnic bodies wherein said process involves, a) combining an azide, a metal oxide and a solvent to form a slurry of said bodies, b) separating said solvent from solids to form core/-shell structures wherein said bodies are comprised of azide wherein said azide forms said core and said shell is comprised of a single or plurality of metal oxides said bodies forming said aggregates.

2. The process of claim 1 wherein said bodies comprise a single or plurality of azide-oxidizer redox couples wherein said couples provide an exothermic reaction, said azide component comprising an average particle size of less than about 8 microns in its longest crystal dimension and said metal oxide comprising an average particle size of less than about 1 micron in diameter.

3. The process of claim 1 wherein said azide is combined with metals and/or the salts thereof selected from the group consisting of an alkali metal, and alkaline earth metal and/or some combination thereof and/or therebetween.

4. The process of claim 2 wherein said oxidizer is combined with metals selected from the group consisting of iron, silicon, nickel, vanadium, copper, titanium, manganese, aluminum, zinc, tantalum, niobium, some combination thereof and/or therebetween.

5. The process of claim 2 wherein said oxidizer consists of iron oxide, silicon oxide, and/or some combination thereof and/or therebetween.

6. The process of claim 1 wherein said azide core dimension is less than about 5 microns in diameter.

7. The process of claim 1 wherein said azide core dimension is less than about 3 microns in diameter.

8. The process of claim 1 wherein said azide core dimension is less than about 2 microns in diameter.

9. The process of claim 2 wherein said oxidizer is less than about 0.5 microns in diameter.

10. The process of claim 2 wherein said oxidizer is less than about 0.2 microns in diameter.

11. The process of claim 2 wherein said bodies are formed in a dilute dispersion by turbulent injection of aqueous azide solution comprising dispersed oxide in a solvent, said dispersed oxide is concentrated by partial liquid phase removal, upon injection said azide precipitates out of solution said oxidizer contemporaneously coating said azide forming said slurry in concentrated form.

12. The process of claim 11 wherein said concentrated slurry is formed by hydrocyclone.

13. The process of claim 11 wherein said aggregates are formed into a prill by a vibration spray-head prilling system.

14. The process of claim 13 wherein said prill is about 200 microns in diameter.

* * * * *